United States Patent [19]

King

[11] 4,218,870

[45] Aug. 26, 1980

[54] FALSE TWIST MACHINE

[75] Inventor: Jerry N. King, Reidville, S.C.

[73] Assignee: Milliken Research Corporation, Spartanburg, S.C.

[21] Appl. No.: 970,478

[22] Filed: Dec. 18, 1978

[51] Int. Cl.[3] ..... D01H 7/92; D02G 1/08

[52] U.S. Cl. ..... 57/284; 57/334; 57/337; 57/338; 57/339

[58] Field of Search ..... 57/337–340, 57/284

[56] References Cited

U.S. PATENT DOCUMENTS

| | | | |
|---|---|---|---|
| 3,287,890 | 11/1966 | McIntosh et al. | 57/339 |
| 3,901,011 | 8/1975 | Schuster | 57/339 |
| 3,998,041 | 12/1976 | Graf et al. | 57/337 |
| 4,115,987 | 9/1978 | Taniguchi et al. | 57/339 |
| 4,134,252 | 1/1979 | Otaki et al. | 57/339 X |

*Primary Examiner*—Donald Watkins

*Attorney, Agent, or Firm*—Earle R. Marden; H. William Petry

[57] ABSTRACT

An improved false twist machine employing a friction disc arrangement which provides high twist in the multi-filament yarn on the entering side and increased yarn feeding rate on the outlet side to reduce the tension of the exiting yarn to lessen the number of filament breaks. The friction disc arrangement has discs of increased thickness to diameter ratio on the entering side when compared to the exit side, to provide increased yarn angle to accomplish the desired high twist. The reduced thickness to diameter ratio on the exit side increases yarn forwarding action, thus reducing the outlet tension.

14 Claims, 6 Drawing Figures

FALSE TWIST MACHINE

In the texturing of continuous filament synthetic yarn, it is desired to provide a high twist in the yarn to provide good bulk as well as interlocking of the individual filaments of the yarn. In the use of relatively smooth wear resistant friction discs to provide the textured effect by false twist, the yarn to disc geometry required to generate the desired high twist tends to cause high tension at the outlet of the friction disc device resulting in excessive yarn filament breakage.

Therefore, it is an object of the invention to provide a false twist texturing machine which employs a friction disc arrangement that provides a high twist in the yarn with relatively smooth wear resistant discs which produce very low levels of yarn abrasion, while maintaining the outlet tension from the friction disc arrangement at a desired level to maintain yarn filament breakage at a minimum.

Other objects and advantages will become clearly apparent as the specification proceeds to describe the invention with reference to the accompanying drawings, in which.

Figure 1:
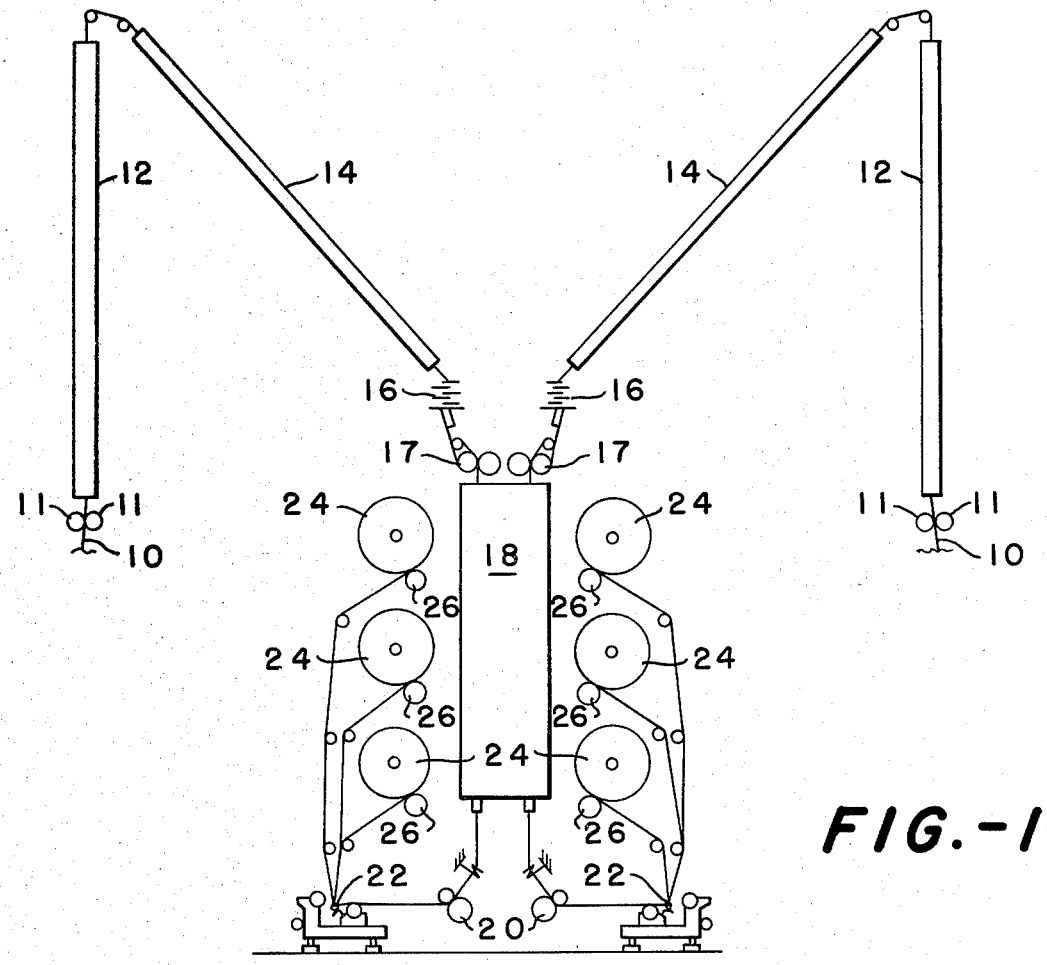
FIG. 1 is a side cross-sectional view of a friction disc yarn false twisting machine.
Figure 2:
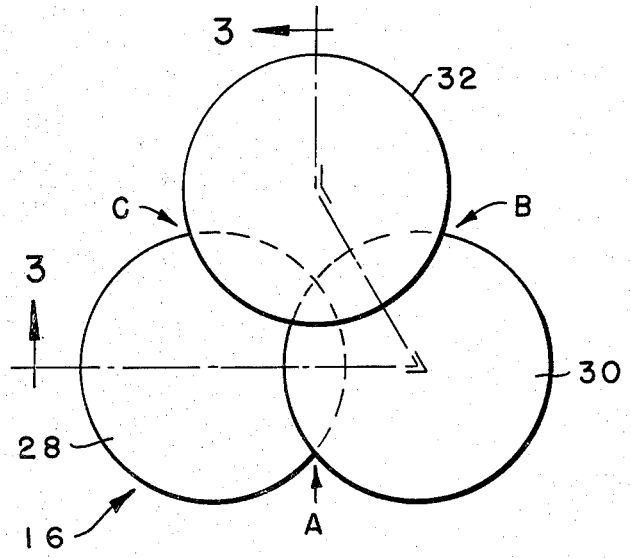
FIG. 2 is a top schematic view of the friction disc spindle used on the machine of FIG. 1.
Figure 3:
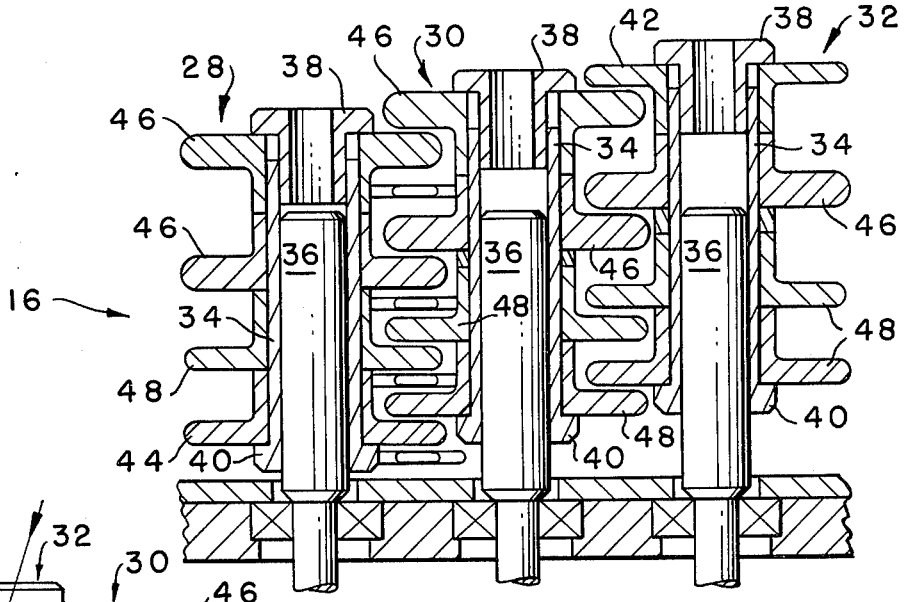
FIG. 3 is a cross-sectional view taken on line 3—3 of FIG. 2.

Looking now to FIG. 1, a conventional false twist machine for continuous multi-filament synthetic yarn 10 is schematically represented. Each of the yarns 10 are supplied from creels (not shown) over suitable rolls to individual positions which are identical to that represented in FIG. 1. The yarn 10 is supplied initially up through the primary heater 12 by rolls 11 and down through a cooling zone 14 to the friction false twist disc arrangement 16. From the friction false twist disc arrangement 16, the yarn 10 then passes over feed rolls 17 downwardly through the secondary heater 18 to the nip rolls 20. From the nip rolls 20, the textured yarn 10 pass through the guide eyelet 22 to the yarn take-up package 24 driven by surface drive roll 26.

The basic set-up of the friction disc 16 arrangement is conventional in that three stacks of discs are employed to provide false twist to the yarn 10 as it passes through the friction disc arrangement. As briefly discussed before, it is desired to provide a friction disc arrangement which provides a high level of twist when using relatively smooth wear resistant disc surfaces with sufficiently low outlet tension to maintain a low number of broken yarn filaments in order to achieve maximum running efficiency of the false twist texturing machine. To this end is provided the friction false twist arrangement shown in FIGS. 2–6. Basically, each friction disc stack 28, 30 and 32 consists of four disc members telescoped over a sleeve member 34 suitably mounted on a drive shaft 36. The disc members are maintained in position by a plug 38 inserted into the sleeve member 34 exerting a downward force on the disc stack against the flange portion 40 of the sleeve member 34. The basic desired arrangement of discs is a 1-5-5-1 arrangement in which the initial and exit discs 42 and 44, respectively, are relatively thin, smooth, low friction guide discs while the other ten discs are the actual false twist inserting discs of a higher friction co-efficient. In the disclosed invention, it is preferred to employ five relatively thick discs 46 on the inlet side of the false twist arrangement 16 to provide maximum twist and five relatively thin discs 48 on the outlet side of arrangement 16 to provide lower tension and therefore less broken filaments.

Preferably, the discs 46 are 6 mm thick while the discs 48 are 4 mm thick, as well as the inlet and outlet discs 40 and 42. Preferably, the discs are made from aluminum and coated with hard, wear resistant chrome oxide but other suitable materials may be used, if desired. These thicknesses are preferred but can be altered as long as the ratio of the thickness of the disc 46 to the thickness of the disc 48 is approximately 3/2. The particular thickness of the discs 40 and 42 is not critical as long as the yarn 10 is guided properly into and out of the false twist arrangement 16 with a minimum of restraint.

Figure 4:
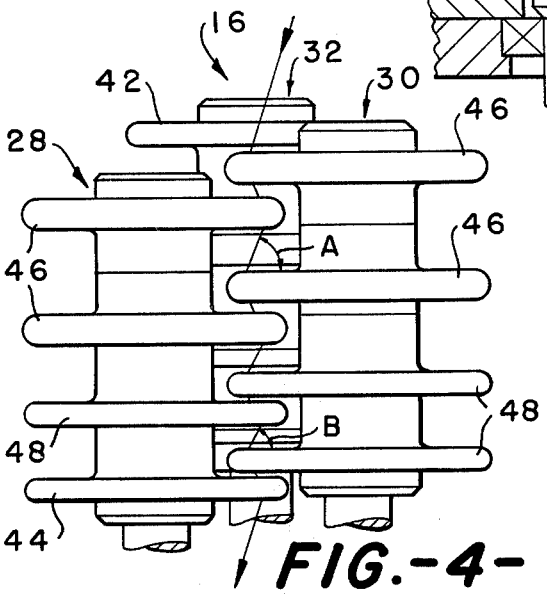
FIGS. 4–6, respectively, are elevation views of the friction disc arrangement taken in the direction indicated by the arrows A, B and C showing schematically the actions of the new and improved friction disc arrangement.
Figure 5:
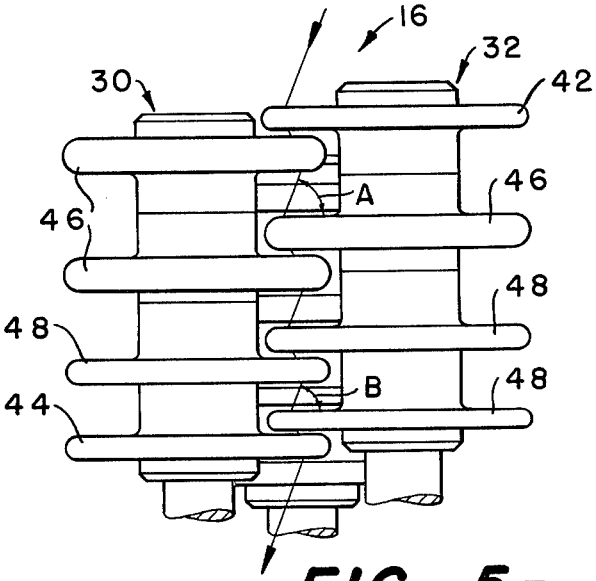
Figure 6:
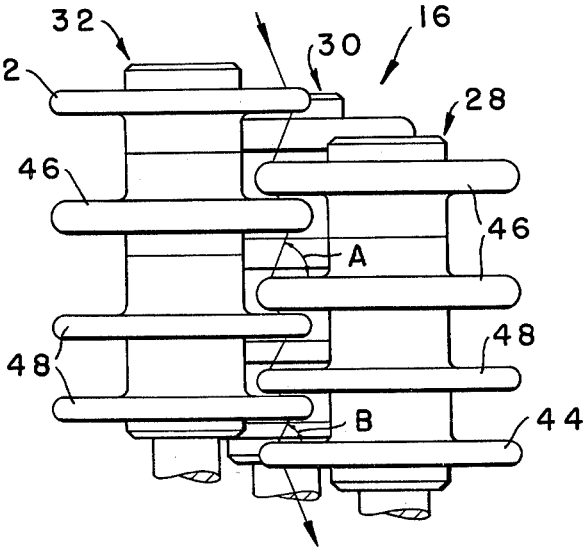

FIGS. 4–6 are planar representations of the flow of yarn through the false twist friction disc arrangement 16. As is well known in the art and as shown in FIGS. 4–6, the yarn while being treated in the false twist unit 16 follows a modified helical path through the unit due to the standard disc construction. In FIGS. 4–6, the angles A and B, respectively, represent the angle of contact of the yarn across the disc. The greater the angle of contact across the disc, the larger will be the ratio of twisting force to forwarding force for a given D/Y ratio, draw ratio, etc. The lower the angle of contact across the disc, the smaller will be the ratio of the twisting force to forwarding force for a given D/Y ratio, draw ratio, etc. The unique combination of these two geometrical conditions result in the very desirable characteristic of high texturing twist, low yarn abrasive damage, and low levels of filament breaks at high texturing speeds. In the preferred form of the invention, the angle of inclination A across the discs 46 is in the range of 66°–70° and is preferably about 68°. The angle of inclination B across the discs 48 is in the range of 59°–63° and is preferably about 61°. These angles along with the respective disc thickness provides the desired twist in the upper region of the false twist arrangement and at the same time, allows the exit velocity of the yarn to increase to reduce the exit tension on the yarn resulting in reduced yarn filament breakage. The over-all resultant friction false twisted yarn has a high number of turns per inch with a minimum number of filament breaks.

To illustrate the above noted results comparative tests were run with different disc thickness arrangements on an Ernest Scragg & Sons Limited, SDS-8 Friction False Twist Machine with a 2.5 meter thermasyphon primary heater at 235° C. and a 1.5 meter secondary electric heater with a yarn through put of 750 meters/minute. The yarn run was a DuPont 255/150/34, Type 56T, Merge Number 12129 supplied at 255 denier and drawn to 150 denier and the following results were obtained:

| | DISC AND SPINDLE TYPE | | | | |
|---|---|---|---|---|---|
| | A | B | C | D | E |
| | Standard Scragg SDS-8 1-10-1 4mm. | Scragg SDS-8 Composite Stack Components 1-10-1 4mm. | Scragg SDS-8 Composite Stack Components 0-9-0 6mm. | Scragg SDS-8 Composite Stack Components 0-9-0 6mm. | Scragg SDS-8 Composite Stack 1-5-5-1 6mm. 4mm. |
| $t_1$ | 50.4 | 59.8 | (unstable) | 48.0 | 46.8 |
| $t_2$ | 33.0 | 51.0 | (unstable) | 51.4 | 43.2 |
| $t_{2/t}$ | 0.65 | 0.85 | (unstable) | 1.07 | 0.93 |
| Yarn Helix | 51.9 | 48.4 | (unstable) | 52.8 | 53.3 |
| False Twist | 57.8 | 53.8 | (unstable) | 58.8 | 59.4 |
| Crimp Contraction | 40 | 33 | 20 | 45 | 45 |
| Breaking Strength | 517 | 604 | 618 | 628 | 644 |
| Breaking Elongation | 14.4 | 17.5 | 21.6 | 19.9 | 19.9 |
| Broken Filaments | 4 | 36 | 24 | 6 | 3 |

$t_1$ = Entering tension to friction false twist unit in grams
$t_2$ = Leaving tension from friction false twist unit in grams
$t_{2/t}$ = Ratio of $t_2$ to $t_1$
Yarn Helix = *Degrees of Helix Angle*
False Twist = *Resultant twist in turns/inch*
Crimp Contraction = *% of contraction of textured yarn when heated in relaxed state*
Breaking Strength = *Resultant strength in grams of textured yarn*
Breaking Elongation = *% of resultant elongation of textured yarn*
Broken Filaments = *Number of broken filaments per 1000 meters in resultant yarn*

Test runs A-E were run using the indicated disc thickness in the friction false twist zone. It should be noted that runs C and D were run with identical discs, but that the twist and tensions on run C were unstable. To correct this condition, the ratio of the disc to yarn velocity (D/Y ratio) on run D was increased to correct the unstable running conditions. It can readily be seen that run E with five, 6 mm discs on the entering zone and five, 4 mm discs on the exiting zone resulted in the best combination of high false twist, low filament breakage and high yarn strength due to low yarn abrasion damage. In other words, the unique combination of friction false twist elements provide a resultant yarn which has (1) high false twist, low yarn abrasion damage, low output tensions and extremely long disc wear life.

Although the preferred embodiment of the invention has been described in detail, it is contemplated that many changes may be made without departing from the scope or spirit of the invention, and I desire to be limited only by the claims.

That which is claimed is:

1. In a friction false twist yarn producing machine having a primary heater, a cooling zone, a secondary heater and a means to take up treated yarn, the improvement comprising a friction false twist device located between said primary and said secondary heaters, said friction false twist device including at least one stack of rotatably mounted substantially circular discs, said stack of substantially circular discs having at least one disc in said stack on the inlet side thereof of greater thickness than the discs on the outlet side of said stack, means to rotate said stack of discs and means to cause yarn to engage the peripheral edges of said discs to insert a false twist in the yarn.

2. The machine of claim 1 wherein said disc of greater thickness is about six millimeters thick.

3. The machine of claim 2 wherein the discs on the outlet side of said stack are about four millimeters thick.

4. The machine of claim 1 wherein said false twist device includes at least two additional stacks of substantially circular discs, each stack of discs being operably associated with the other stacks to provide a false twist to a yarn passed therethrough, each of the two additional stacks having at least one disc on the inlet side thereof of a thickness greater than the thickness of the discs on the outlet side thereof.

5. The machine of claim 4 wherein at least two discs in two of said stacks are thicker than the other discs in said stacks.

6. The machine of claim 4 wherein said thicker discs are approximately six millimeters in thickness.

7. The machine of claim 6 wherein said thinner discs are approximately four millimeters in thickness.

8. A false twist spindle arrangement for a friction false twist producing machine comprising: at least three spindles adjacent and operably associated with one another, each of said spindles having at least four friction discs mounted thereon projecting between the discs on the other spindles, two of said spindles each having two discs thereon thicker and the other two discs on the spindle, the third having one disc thereon thicker than the other three discs on the spindle and means to retain said discs on each of said spindles.

9. The spindle arrangement of claim 8 wherein said thicker discs are approximately six millimeters in thickness.

10. The spindle arrangement of claim 9 wherein said thinner discs are approximately four millimeters in thickness.

11. The spindle arrangement of claim 8 wherein the relative thickness of the thick discs to the thin discs is approximately 3 to 2.

12. A method of false twisting a synthetic, multi-filament yarn in a friction false twist spindle having at least one rotably mounted stack of substantially circular discs with at least one disc being thicker than the other said discs comprising the steps of: passing the yarn to be false twisted across and in contact with the thicker disc at angle in the range of 66°-70° to provide a twist therein, then passing the yarn across and in contact with the thinner discs at an angle in the range of 59°-63° and then taking up the yarn.

13. The method of claim 12 wherein the yarn is passed across the thicker disc at an angle of about 68°.

14. The method of claim 13 wherein the yarn is passed across the thinner discs at an angle of about 61°.

* * * * *